US011433514B2

(12) United States Patent
Hsieh

(10) Patent No.: US 11,433,514 B2
(45) Date of Patent: Sep. 6, 2022

(54) DRIVING HEAD STRUCTURE OF SOCKET WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 207 days.

(21) Appl. No.: 16/726,270

(22) Filed: Dec. 24, 2019

(65) Prior Publication Data

US 2020/0376636 A1 Dec. 3, 2020

Related U.S. Application Data

(60) Provisional application No. 62/856,153, filed on Jun. 3, 2019.

(51) Int. Cl.

| | |
|---|---|
| ***B25B 23/00*** | (2006.01) |
| ***B25B 13/06*** | (2006.01) |
| ***B25B 13/46*** | (2006.01) |
| ***B25B 15/00*** | (2006.01) |

(52) U.S. Cl.

CPC ..... *B25B 23/0035* (2013.01); *B25B 13/06* (2013.01); *B25B 13/46* (2013.01); *B25B 13/463* (2013.01); *B25B 15/001* (2013.01)

(58) Field of Classification Search

CPC ... B25B 23/0035; B25B 13/06; B25B 13/463; B25B 15/001; B25B 13/46; B25B 13/065; B25B 23/0007

USPC ..... 81/124.6, 60–63.2, 177.85, 121.1; 173/1

See application file for complete search history.

(56) References Cited

U.S. PATENT DOCUMENTS

| | | | | |
|---|---|---|---|---|
| 1,371,965 | A * | 3/1921 | York | B25B 13/48 81/460 |
| 2,600,924 | A * | 6/1952 | Royer | B25B 27/18 81/53.2 |
| 2,896,985 | A * | 7/1959 | Braatz | B25B 13/06 403/328 |
| 5,910,197 | A * | 6/1999 | Chaconas | B25B 13/06 81/124.6 |
| 6,209,423 | B1 * | 4/2001 | Shiao | B25B 13/463 192/43.1 |
| 6,240,813 | B1 * | 6/2001 | Hyatt | B21K 5/16 81/124.6 |
| 2010/0326249 | A1 * | 12/2010 | Super | B25B 15/001 81/177.85 |
| 2013/0126197 | A1 * | 5/2013 | Lisle | B25B 13/46 173/1 |
| 2020/0215667 | A1 * | 7/2020 | Tamura | B25B 21/026 |
| 2020/0384619 | A1 * | 12/2020 | Ross | B25B 23/0035 |

* cited by examiner

*Primary Examiner* — Orlando E Aviles
*Assistant Examiner* — Jason Khalil Hawkins
(74) *Attorney, Agent, or Firm* — CKC & Partners Co., LLC

(57) ABSTRACT

A driving head structure of a socket wrench includes an assembling base and a joint portion. The assembling base includes a plurality of convex curved surfaces. The joint portion is disposed on the assembling base. The assembling base is cylinder-shaped, and the joint portion is cuboid-shaped. Each of the convex curved surfaces is contacted with each side of the joint portion.

10 Claims, 7 Drawing Sheets

DRIVING HEAD STRUCTURE OF SOCKET WRENCH

RELATED APPLICATIONS

This application claims priority to U.S. Provisional Application Ser. No. 62/856,153, filed Jun. 3, 2019, which is herein incorporated by reference.

BACKGROUND

Technical Field

The present disclosure relates to a driving head structure. More particularly, the present disclosure relates to a driving head structure of a socket wrench.

Description of Related Art

A socket wrench is a common hand tool for easily locking a screw. A driving head structure of the socket wrench is for being connected to a socket, and the socket is for locking the screw. Therefore, a connecting strength between the driving head structure and the socket is important for the socket wrench.

However, if the connecting strength between the joint portion and the assembling base is not strong enough, the joint portion may be broken in case of high torque force. Also, the socket wrench is not easily rotated in case of high torque force. Hence, how to enhance the connecting strength between the joint portion and the assembling base is one of major problems of the socket wrench.

SUMMARY

According to one aspect of the present disclosure, a driving head structure of a socket wrench includes an assembling base and a joint portion. The assembling base includes a plurality of convex curved surfaces. The joint portion is disposed on the assembling base. The assembling base is cylinder-shaped, and the joint portion is cuboid-shaped. Each of the convex curved surfaces is contacted with each side of the joint portion.

According to another aspect of the present disclosure, a driving head structure of a socket wrench includes an assembling base, a connecting base and a joint portion. The connecting base is disposed on the assembling base and includes a plurality of convex curved surfaces. The joint portion is disposed on the connecting base. The assembling base and the connecting base are cylinder-shaped, and the joint portion is cuboid-shaped. Each of the convex curved surfaces is contacted with each side of the joint portion.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
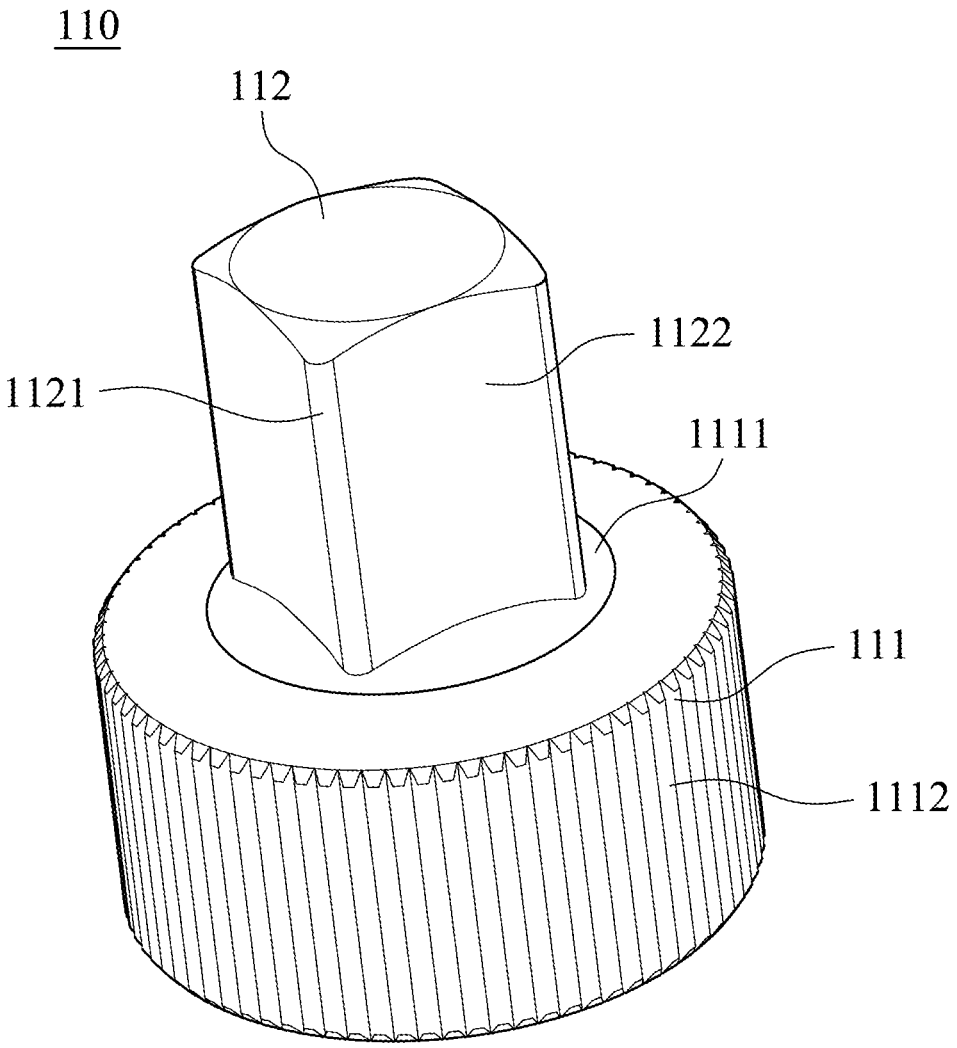
FIG. 1 is an appearance schematic view of a driving head structure of a socket wrench according to the 1st embodiment of the present disclosure.
Figure 2:
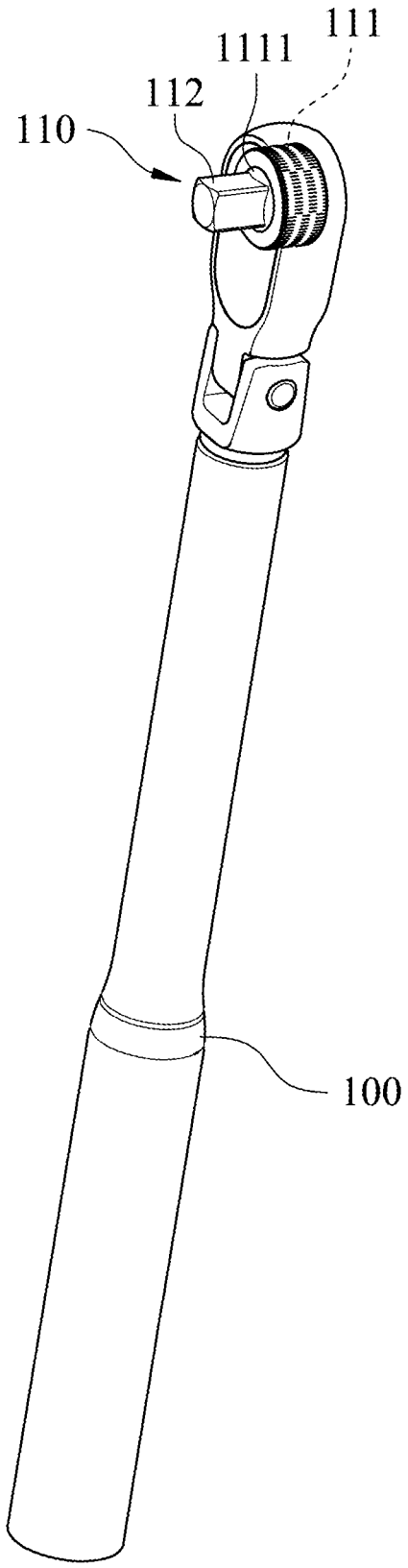
FIG. 2 is a disposition schematic view of the driving head structure of the socket wrench assembled with the socket wrench according to the 1st embodiment of FIG. 1.

FIG. 1 is an appearance schematic view of a driving head structure 110 of a socket wrench 100 according to the 1st embodiment of the present disclosure, and FIG. 2 is a disposition schematic view of the driving head structure 110 of the socket wrench 100 assembled with the socket wrench 100 according to the 1st embodiment of FIG. 1. In FIG. 1, the driving head structure 110 of the socket wrench 100 includes an assembling base 111 and a joint portion 112.

Furthermore, the assembling base 111 includes a plurality of convex curved surfaces 1111. In detail, a number of the convex curved surfaces 1111 is four, but is not limited thereto. The joint portion 112 is disposed on the assembling base 111 and has a plurality of edges 1121. In detail, a number of the edges 1121 is four, the edges 1121 of the joint portion 112 are arc edges, but is not limited thereto. Therefore, the arc edges are favorable for promoting a security. The assembling base 111 is cylinder-shaped, and the joint portion 112 is cuboid-shaped. Each of the convex curved surfaces 1111 is contacted with each side 1122 of the joint portion 112, and each side 1122 of the joint portion 112 is between two of the edges 1121. Via the arrangement of the convex curved surfaces 1111, the connection strength between the assembling base 111 and the joint portion 112 can be promoted, and the torque force and the mechanical strength of the driving head structure 110 of the socket wrench 100 can be increased.

Furthermore, the assembling base 111 includes a plurality of teeth 1112 located on an outer surface thereof. Therefore, it is favorable for enhancing the engaging force by the teeth 1112 during rotating the socket wrench 100.

In FIG. 2, the driving head structure 110 of the socket wrench 100 is assembled on the socket wrench 100. In detail, the assembling base 111 is assembled in the socket wrench 100. The driving head structure 110 of the socket wrench 100 can be assembled on another type of a socket wrench, and is not limited to the type of the socket wrench 100 of the present disclosure.

Figure 3:
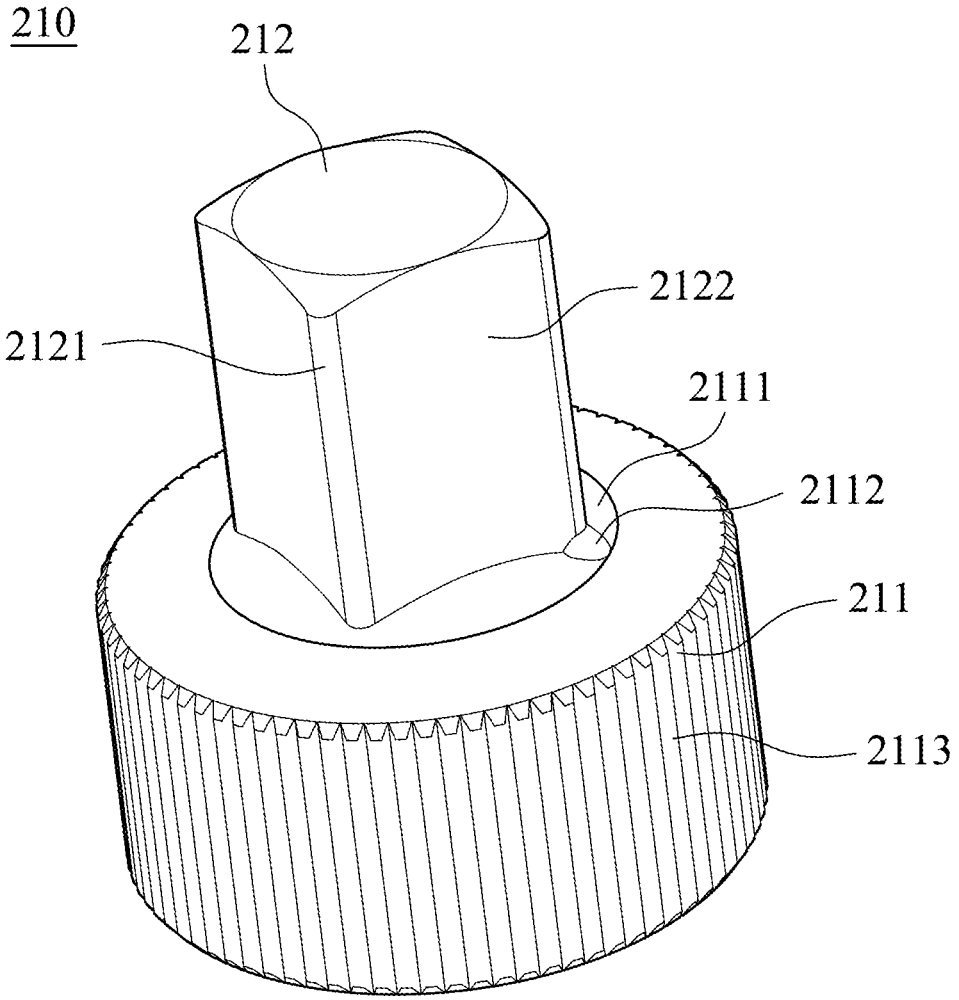
FIG. 3 is an appearance schematic view of a driving head structure of a socket wrench according to the 2nd embodiment of the present disclosure.

FIG. 3 is an appearance schematic view of a driving head structure 210 of a socket wrench according to the 2nd embodiment of the present disclosure. In FIG. 3, the driving head structure 210 of the socket wrench (not shown) includes an assembling base 211 and a joint portion 212.

Furthermore, the assembling base 211 includes a plurality of convex curved surfaces 2111 and at least one convex portion 2112. In detail, a number of the convex curved surfaces 2111 is four, but is not limited thereto. The joint portion 212 is disposed on the assembling base 211 and has a plurality of edges 2121. In detail, a number of the edges 2121 is four, the edges 2121 of the joint portion 212 are arc edges, but is not limited thereto. Therefore, the arc edges are favorable for promoting a security. The assembling base 211 is cylinder-shaped, and the joint portion 212 is cuboid-shaped. Each of the convex curved surfaces 2111 is contacted with each side 2122 of the joint portion 212, and each side 2122 of the joint portion 212 is between two of the edges 2121. Via the arrangement of the convex curved surfaces 2111, the connection strength between the assembling base 211 and the joint portion 212 can be promoted, and the torque force and the mechanical strength of the driving head structure 210 of the socket wrench can be increased.

Furthermore, the convex portion 2112 is located between any two of the convex curved surfaces 2111 adjacent to each other and connected to the joint portion 212, and the convex portion 2112 is connected to one of the edges 2121. In detail, the convex portion 2112 is in a shape of a bump, but is not limited thereto. Therefore, the torque force and the mechanical strength of the driving head structure 210 of the socket wrench can be enhanced via the convex portion 2112. A number of the convex portion 2112 according to the embodiment of FIG. 3 is one, but the number of the convex portion 2112 is not limited thereof.

Moreover, the assembling base 211 includes a plurality of teeth 2113 located on an outer surface thereof. Therefore, it is favorable for enhancing the engaging force by the teeth 2113 during rotating the socket wrench.

Figure 4:
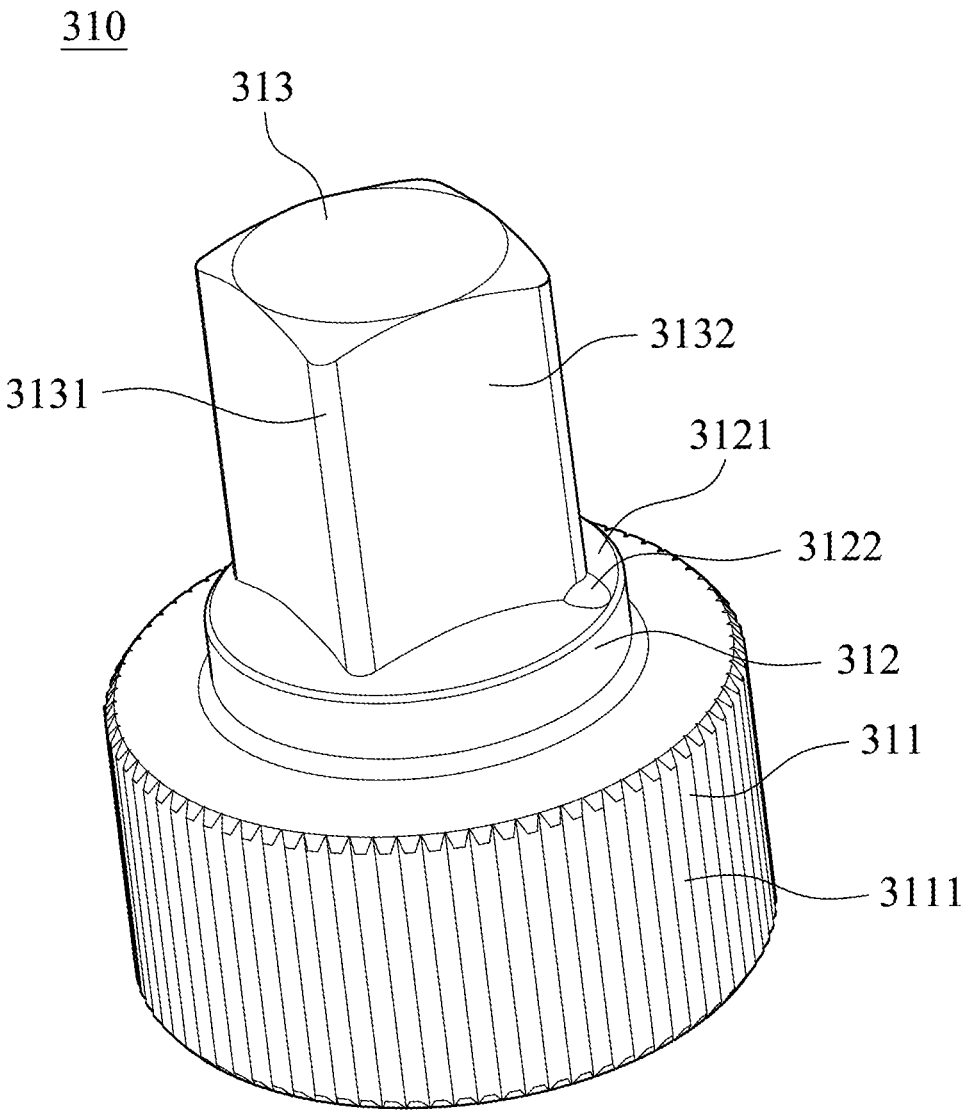
FIG. 4 is an appearance schematic view of a driving head structure of a socket wrench according to the 3rd embodiment of the present disclosure.

FIG. 4 is an appearance schematic view of a driving head structure 310 of a socket wrench according to the 3rd embodiment of the present disclosure. In FIG. 4, the driving head structure 310 of the socket wrench (not shown) includes an assembling base 311, a connecting base 312 and a joint portion 313.

Furthermore, the connecting base 312 is disposed on the assembling base 311 and includes a plurality of convex curved surfaces 3121 and at least one convex portion 3122. In detail, a number of the convex curved surfaces 3121 is four, but is not limited thereto. The joint portion 313 is disposed on the connecting base 312 and has a plurality of edges 3131. In detail, a number of the edges 3131 is four, the edges 3131 of the joint portion 313 are arc edges, but is not limited thereto. Therefore, the arc edges are favorable for promoting a security. The assembling base 311 and the connecting base 312 are cylinder-shaped, and the joint portion 313 is cuboid-shaped. Each of the convex curved surfaces 3121 is contacted with each side 3132 of the joint portion 313, and each side 3132 of the joint portion 313 is between two of the edges 3131. A diameter of the assembling base 311 is larger than a diameter of the connecting base 312. Via the arrangement of the convex curved surfaces 3121, the connection strength between the assembling base 311 and the joint portion 313 can be promoted, and the torque force and the mechanical strength of the driving head structure 310 of the socket wrench can be increased.

Furthermore, the convex portion 3122 is located between any two of the convex curved surfaces 3121 adjacent to each other and connected to the joint portion 313, and the convex portion 3122 is connected to one of the edges 3131. In detail, the convex portion 3122 is in a shape of a bump, but is not limited thereto. Therefore, the torque force and the mechanical strength of the driving head structure 310 of the socket wrench can be enhanced via the convex portion 3122. A number of the convex portion 3122 according to the embodiment of FIG. 4 is one, but the number of the convex portion 3122 is not limited thereof.

Moreover, the assembling base 311 includes a plurality of teeth 3111 located on an outer surface thereof. Therefore, it is favorable for enhancing the engaging force by the teeth 3111 during rotating the socket wrench.

Figure 5:
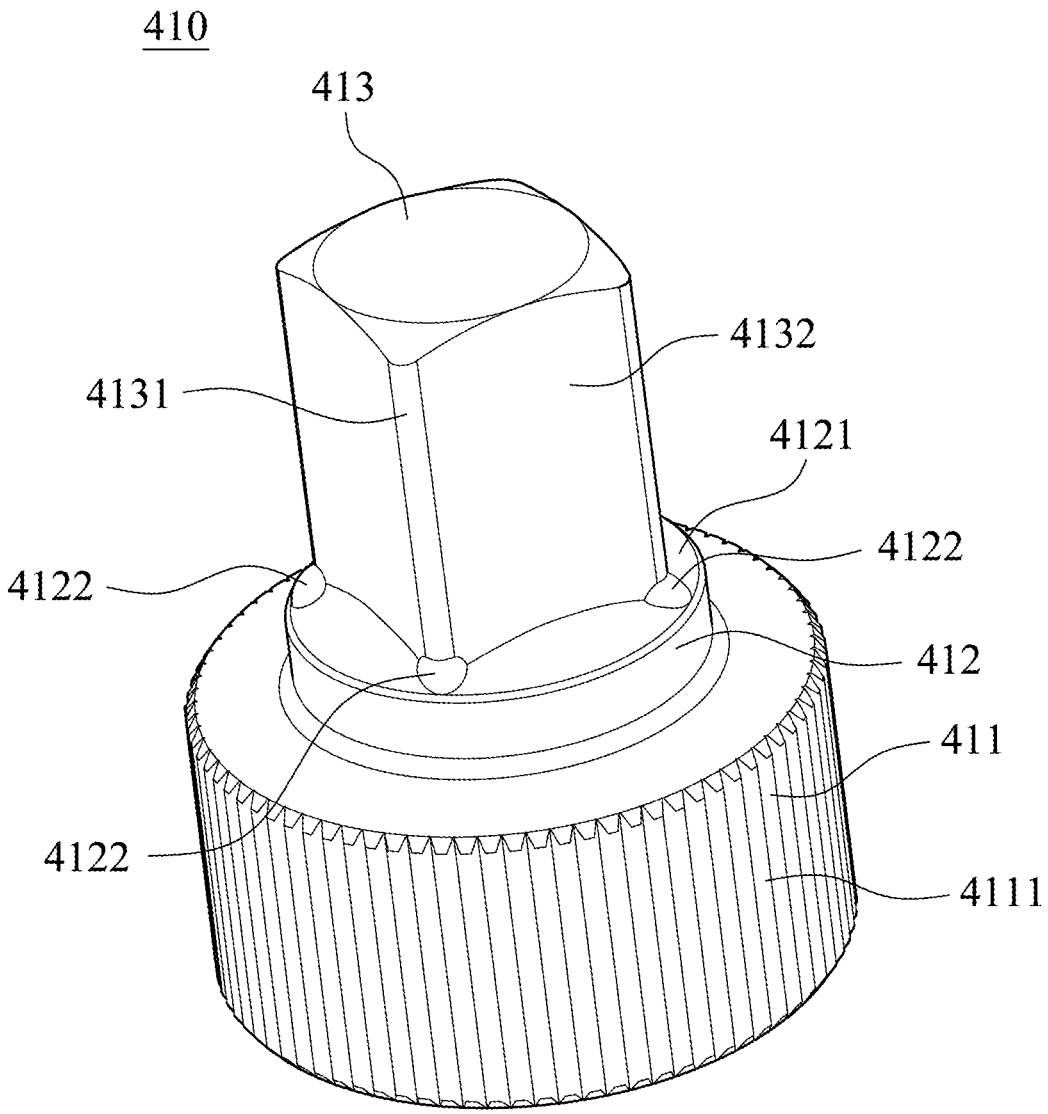
FIG. 5 is an appearance schematic view of a driving head structure of a socket wrench according to the 4th embodiment of the present disclosure.

FIG. 5 is an appearance schematic view of a driving head structure 410 of a socket wrench according to the 4th embodiment of the present disclosure. In FIG. 5, the driving head structure 410 of the socket wrench (not shown) includes an assembling base 411, a connecting base 412 and a joint portion 413.

Furthermore, the connecting base 412 is disposed on the assembling base 411 and includes a plurality of convex curved surfaces 4121 and convex portions 4122. In detail, a number of the convex curved surfaces 4121 is four, a number of the convex portions 4122 is four, but is not limited thereto. The joint portion 413 is disposed on the connecting base 412 and has a plurality of edges 4131. In detail, a number of the edges 4131 is four, the edges 4131 of the joint portion 413 are arc edges, but is not limited thereto. Therefore, the arc edges are favorable for promoting a security. The assembling base 411 and the connecting base 412 are cylinder-shaped, and the joint portion 413 is cuboid-shaped. Each of the convex curved surfaces 4121 is contacted with each side 4132 of the joint portion 413, and each side 4132 of the joint portion 413 is between two of the edges 4131. A diameter of the assembling base 411 is larger than a diameter of the connecting base 412. Via the arrangement of the convex curved surfaces 4121, the connection strength between the assembling base 411 and the joint portion 413 can be promoted, and the torque force and the mechanical strength of the driving head structure 410 of the socket wrench can be increased.

Furthermore, each of the convex portions 4122 is located between any two of the convex curved surfaces 4121 adjacent to each other and connected to the joint portion 413, and each of the convex portions 4122 is connected to one of the edges 4131. In detail, each of the convex portions 4122 is in a shape of a bump, but is not limited thereto. Therefore, the torque force and the mechanical strength of the driving head structure 410 of the socket wrench can be enhanced via the convex portions 4122.

Moreover, the assembling base 411 includes a plurality of teeth 4111 located on an outer surface thereof. Therefore, it is favorable for enhancing the engaging force by the teeth 4111 during rotating the socket wrench.

Figure 6:
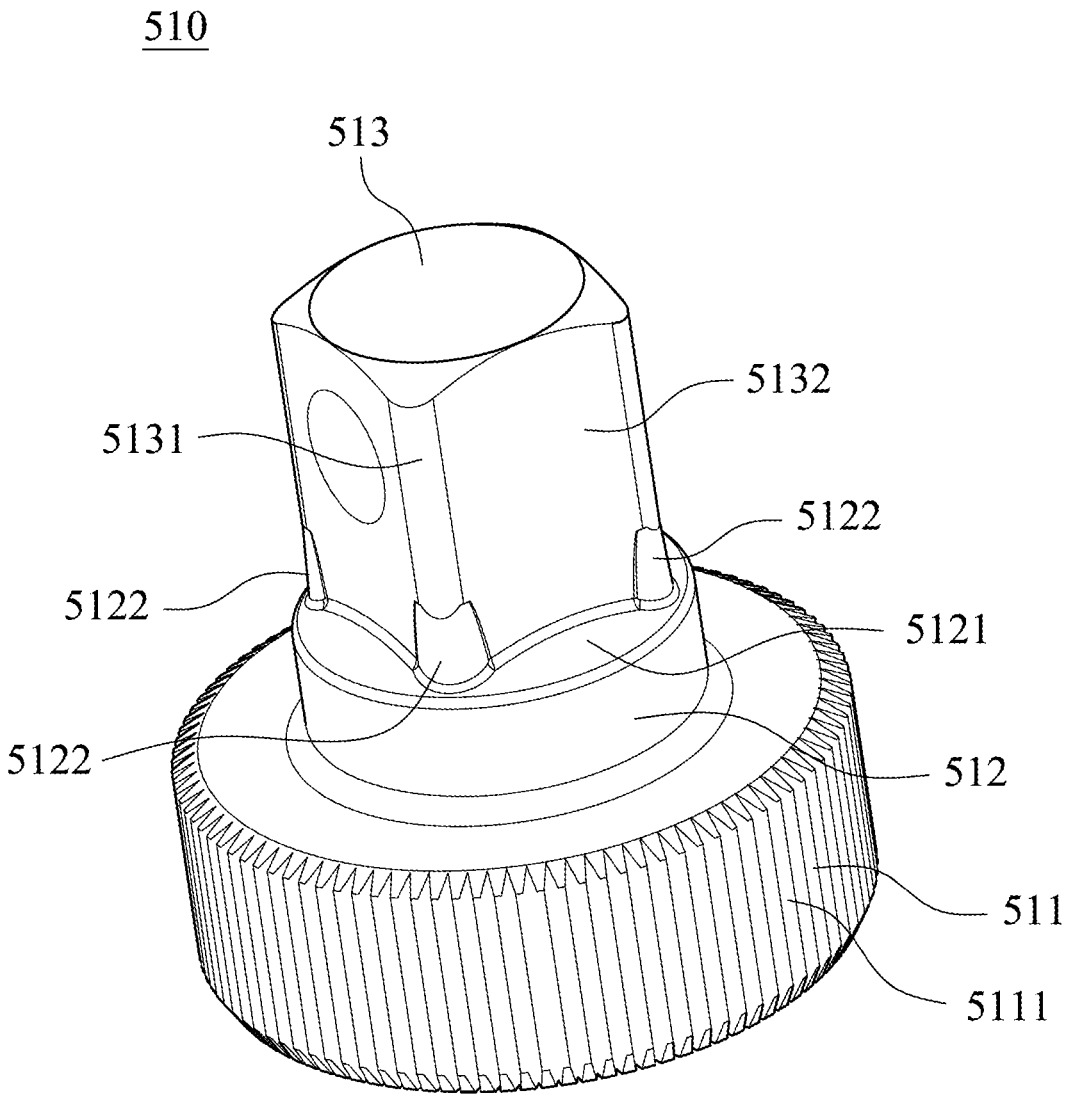
FIG. 6 is an appearance schematic view of a driving head structure of a socket wrench according to the 5th embodiment of the present disclosure.

FIG. 6 is an appearance schematic view of a driving head structure 510 of a socket wrench according to the 5th embodiment of the present disclosure. In FIG. 6, the driving head structure 510 of the socket wrench (not shown) includes an assembling base 511, a connecting base 512 and a joint portion 513.

Furthermore, the connecting base 512 is disposed on the assembling base 511 and includes a plurality of convex curved surfaces 5121 and convex portions 5122. In detail, a number of the convex curved surfaces 5121 is four, a number of the convex portions 5122 is four, but is not limited thereto. The joint portion 513 is disposed on the connecting base 512 and has a plurality of edges 5131. In detail, a number of the edges 5131 is four, the edges 5131 of the joint portion 513 are arc edges, but is not limited thereto. Therefore, the arc edges are favorable for promoting a security. The assembling base 511 and the connecting base 512 are cylinder-shaped, and the joint portion 513 is cuboid-shaped. Each of the convex curved surfaces 5121 is contacted with each side 5132 of the joint portion 513, and each side 5132 of the joint portion 513 is between two of the edges 5131. A diameter of the assembling base 511 is larger than a diameter of the connecting base 512. Via the arrangement of the convex curved surfaces 5121, the connection strength between the assembling base 511 and the joint portion 513 can be promoted, and the torque force and the mechanical strength of the driving head structure 510 of the socket wrench can be increased.

Furthermore, each of the convex portions 5122 is located between any two of the convex curved surfaces 5121 adjacent to each other and connected to the joint portion 513, and each of the convex portions 5122 is connected to one of the edges 5131. In detail, each of the convex portions 5122 is in a shape of a curved sheet, but is not limited thereto. Therefore, the torque force and the mechanical strength of the driving head structure 510 of the socket wrench can be enhanced via the convex portions 5122.

Moreover, the assembling base 511 includes a plurality of teeth 5111 located on an outer surface thereof. Therefore, it is favorable for enhancing the engaging force by the teeth 5111 during rotating the socket wrench.

Figure 7:
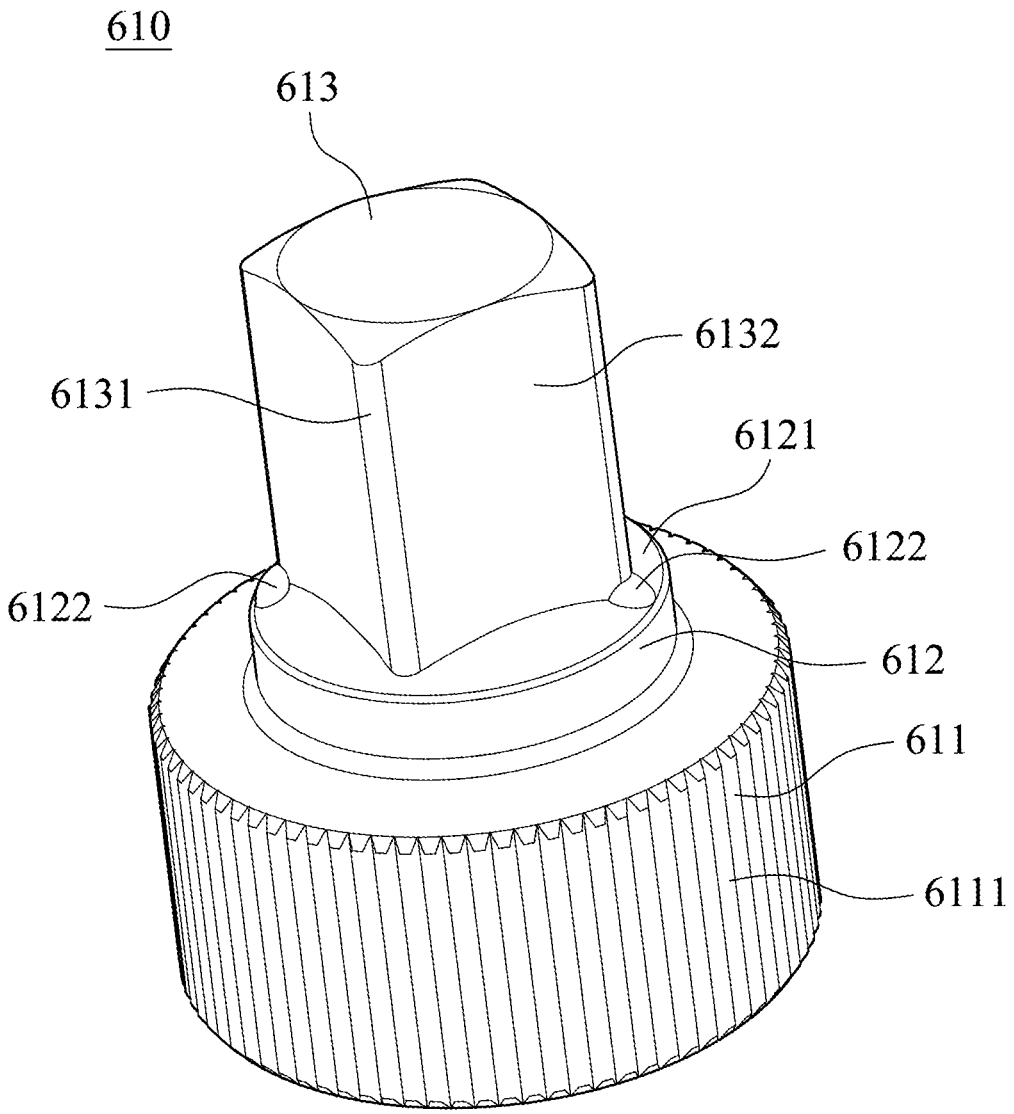
FIG. 7 is an appearance schematic view of a driving head structure of a socket wrench according to the 6th embodiment of the present disclosure.

FIG. 7 is an appearance schematic view of a driving head structure 610 of a socket wrench according to the 6th embodiment of the present disclosure. In FIG. 7, the driving head structure 610 of the socket wrench (not shown) includes an assembling base 611, a connecting base 612 and a joint portion 613.

Furthermore, the connecting base 612 is disposed on the assembling base 611 and includes a plurality of convex curved surfaces 6121 and a plurality of convex portions 6122. In detail, a number of the convex curved surfaces 6121 is four, a number of the convex portions 6122 is two, but is not limited thereto. The joint portion 613 is disposed on the connecting base 612 and has a plurality of edges 6131. In detail, a number of the edges 6131 is four, the edges 6131 of the joint portion 613 are arc edges, but is not limited thereto. Therefore, the arc edges are favorable for promoting a security. The assembling base 611 and the connecting base 612 are cylinder-shaped, and the joint portion 613 is cuboid-shaped. Each of the convex curved surfaces 6121 is contacted with each side 6132 of the joint portion 613, and each side 6132 of the joint portion 613 is between two of the edges 6131. A diameter of the assembling base 611 is larger than a diameter of the connecting base 612. Via the arrangement of the convex curved surfaces 6121, the connection strength between the assembling base 611 and the joint portion 613 can be promoted, and the torque force and the mechanical strength of the driving head structure 610 of the socket wrench can be increased.

Furthermore, each of the convex portions 6122 is located between any two of the convex curved surfaces 6121 adjacent to each other and connected to the joint portion 613, and each of the convex portions 6122 is connected to one of the edges 6131. Moreover, the convex portions 6122 are diagonally located to each other. In detail, each of the convex portions 6122 is in a shape of a bump, but is not limited thereto. Therefore, the torque force and the mechanical strength of the driving head structure 610 of the socket wrench can be enhanced via the convex portions 6122.

Moreover, the assembling base 611 includes a plurality of teeth 6111 located on an outer surface thereof. Therefore, it is favorable for enhancing the engaging force by the teeth 6111 during rotating the socket wrench.

In summary, the following efficiency and advantages can be provided via the driving head structure of the socket wrench of the present disclosure.

First, the disposition of the convex curved surfaces and the convex portion are favorable for enhancing the torque force and the mechanical strength of the driving head structure of the socket wrench.

Second, the disposition of the convex curved surfaces is favorable for increasing the connection strength between the joint portion and the assembling base.

Third, the teeth on the outer surface of the assembling base are favorable for promoting the engaging force during rotating the socket wrench.

The foregoing description, for purpose of explanation, has been described with reference to specific embodiments. It is to be noted that Tables show different data of the different embodiments; however, the data of the different embodiments are obtained from experiments. The embodiments were chosen and described in order to best explain the principles of the disclosure and its practical applications, to thereby enable others skilled in the art to best utilize the disclosure and various embodiments with various modifications as are suited to the particular use contemplated. The embodiments depicted above and the appended drawings are exemplary and are not intended to be exhaustive or to limit the scope of the present disclosure to the precise forms disclosed. Many modifications and variations are possible in view of the above teachings.

What is claimed is:

1. A driving head structure of a socket wrench, comprising:

an assembling base;

a connecting base disposed on the assembling base and comprising a plurality of convex curved surfaces and at least one convex portion; and a joint portion disposed on the connecting base;

wherein the assembling base and the connecting base are cylinder-shaped, and the joint portion is cuboid-shaped;

wherein each of the convex curved surfaces is contacted with each side of the joint portion;

wherein the at least one convex portion is located between any two of the convex curved surfaces adjacent to each other;

wherein the at least one convex portion abuts to the joint portion and an intersecting region, and the intersecting region is defined wherein said any two of the convex curved surfaces meet each other.

2. The driving head structure of the socket wrench of claim 1, wherein the joint portion has a plurality of edges, each side of the joint portion is between two of the edges adjacent to each other, and the at least one convex portion is connected to one of the edges.

3. The driving head structure of the socket wrench of claim 2, wherein the edges of the joint portion are arc edges.

4. The driving head structure of the socket wrench of claim 1, wherein the at least one convex portion is in a shape of a curved sheet or in a shape of a bump.

5. The driving head structure of the socket wrench of claim 1, wherein a number of the at least one convex portion is two, and the convex portions are diagonally located to each other.

6. The driving head structure of the socket wrench of claim 1, wherein the assembling base comprises a plurality of teeth located on an outer surface thereof.

7. The driving head structure of the socket wrench of claim 1, wherein a diameter of the assembling base is larger than a diameter of the connecting base.

8. The driving head structure of the socket wrench of claim 2, wherein the at least one convex portion is directly connected to and overlaps one of the edges of the joint portion.

9. The driving head structure of the socket wrench of claim 8, wherein the connecting base has an upper surface on which the joint portion is disposed and where the convex curved surfaces are formed, the at least one convex portion overlaps a part of the upper surface immediately adjacent to said one of the edges of the joint portion, and said any two of the convex curved surfaces are immediately adjacent to each other.

10. The driving head structure of the socket wrench of claim 7, wherein the diameter of the assembling base is measured at an outermost part of the assembling base, and the diameter of the connecting base is measured at an outermost part of the connecting base.

* * * * *